US010727580B2

(12) United States Patent
Rajagopalan et al.

(10) Patent No.: US 10,727,580 B2
(45) Date of Patent: Jul. 28, 2020

(54) MILLIMETER WAVE ANTENNAS HAVING ISOLATED FEEDS

(71) Applicant: Apple Inc., Cupertino, CA (US)

(72) Inventors: Harish Rajagopalan, San Jose, CA (US); Jennifer M. Edwards, San Francisco, CA (US); Simone Paulotto, Redwood City, CA (US); Bilgehan Avser, Mountain View, CA (US); Hao Xu, Cupertino, CA (US); Rodney A. Gomez Angulo, Santa Clara, CA (US); Travis A. Barbieri, Pacifica, CA (US); Georgios Atmatzakis, Cupertino, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 32 days.

(21) Appl. No.: 16/036,770

(22) Filed: Jul. 16, 2018

(65) Prior Publication Data

US 2020/0021019 A1 Jan. 16, 2020

(51) Int. Cl.

| | |
|---|---|
| ***H01Q 21/00*** | (2006.01) |
| ***H01Q 1/52*** | (2006.01) |
| ***H01Q 9/04*** | (2006.01) |

(52) U.S. Cl.

CPC ..... *H01Q 1/523* (2013.01); *H01Q 9/045* (2013.01); *H01Q 9/0414* (2013.01)

(58) Field of Classification Search

CPC .. H01Q 1/2258; H01Q 1/2266; H01Q 1/2275; H01Q 1/24; H01Q 1/241;

(Continued)

(56) References Cited

U.S. PATENT DOCUMENTS 6,154,176 A * 11/2000 Fathy ..... H01Q 1/38 343/700 MS 6,191,740 B1 2/2001 Kates et al.

(Continued)

FOREIGN PATENT DOCUMENTS

| | | |
|---|---|---|
| CN | 104882672 A | 9/2015 |
| JP | 2017085289 A | 5/2017 |
| KR | 101014347 B1 | 2/2011 |

OTHER PUBLICATIONS

Paulotto et al., U.S. Appl. No. 15/650,627, filed Jul. 14, 2017.

(Continued)

*Primary Examiner* — Huedung X Mancuso

(74) *Attorney, Agent, or Firm* — Treyz Law Group, P.C.; Michael H. Lyons; Matthew R. Williams

(57) ABSTRACT

An electronic device may be provided with antenna structures that convey radio-frequency signals greater than 10 GHz. The antenna structures may include overlapping first and second patches. The first patch may include a hole. A transmission line for the second patch may include a conductive via extending through the hole. The via may be coupled to a first end of a trace. A second end of the trace may be coupled to a feed terminal on the second patch over an additional via. The hole may be located within a central region of the first patch to allow the via to pass through the hole without electromagnetically coupling to the first patch. If desired, adjustable impedance matching circuits may be used to couple selected impedances to the antenna feeds that help ensure that the first and second patch antennas are sufficiently isolated from each other.

12 Claims, 12 Drawing Sheets

(58) Field of Classification Search
CPC ..... H01Q 1/242; H01Q 1/243; H01Q 1/521; H01Q 9/0414; H01Q 9/0442; H01Q 9/045
USPC ..... 343/893
See application file for complete search history.

(56) References Cited

U.S. PATENT DOCUMENTS

| | | | | |
|---|---|---|---|---|
| 6,473,040 | B1 | 10/2002 | Nakamura | |
| 6,734,825 | B1 | 5/2004 | Guo et al. | |
| 6,806,831 | B2 | 10/2004 | Johansson et al. | |
| 7,595,759 | B2 | 9/2009 | Schlub et al. | |
| 8,102,330 | B1 | 1/2012 | Albers | |
| 9,142,886 | B2 | 9/2015 | Lu et al. | |
| 9,263,790 | B2 | 2/2016 | Sanford et al. | |
| 9,331,397 | B2 * | 5/2016 | Jin | H01Q 21/28 |
| 9,609,530 | B2 | 3/2017 | Lea et al. | |
| 9,667,290 | B2 | 5/2017 | Ouyang et al. | |
| 9,917,372 | B2 | 3/2018 | Tong et al. | |
| 9,972,892 | B2 | 5/2018 | Noori et al. | |
| 10,103,424 | B2 | 10/2018 | Noori et al. | |
| 10,418,687 | B2 | 9/2019 | Mow et al. | |
| 2005/0110685 | A1 | 5/2005 | Frederik du Toit | |
| 2006/0267844 | A1 | 11/2006 | Yanagi et al. | |
| 2008/0316121 | A1 | 12/2008 | Hobson et al. | |
| 2014/0203995 | A1 | 7/2014 | Romney et al. | |
| 2014/0210486 | A1 | 7/2014 | Dijkstra | |
| 2015/0194730 | A1 | 7/2015 | Sudo et al. | |
| 2015/0333407 | A1 | 11/2015 | Yamagajo et al. | |
| 2016/0141749 | A1 | 5/2016 | Tagi et al. | |
| 2016/0261023 | A1 | 9/2016 | Di Nallo et al. | |
| 2017/0062938 | A1 | 3/2017 | Cheng et al. | |
| 2017/0110787 | A1 | 4/2017 | Ouyang et al. | |
| 2017/0117754 | A1 | 4/2017 | Noori et al. | |
| 2017/0256867 | A1 | 9/2017 | Ding et al. | |
| 2018/0159203 | A1 * | 6/2018 | Baks | H01Q 1/2283 |
| 2018/0198204 | A1 | 7/2018 | Kovacic | |

OTHER PUBLICATIONS

Abdelaziz, Bandwidth Enhancement of Microstrip Antenna, Progress in Electromagnetics Research, 2006, pp. 311-317, vol. 63.
Khan, MultiBand—Rectangular Dielectric Resonator Antenna (M-RDRA), ResearchGate, 2016, pp. 1-115.

* cited by examiner

MILLIMETER WAVE ANTENNAS HAVING ISOLATED FEEDS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths, but may raise significant challenges. For example, millimeter wave communications signals generated by antennas can be characterized by substantial attenuation and/or distortion during signal propagation. In addition, it can be difficult to ensure that multiple antennas for handling millimeter wave communications are sufficiently isolated from each other.

It would therefore be desirable to be able to provide electronic devices with improved wireless communications circuitry such as communications circuitry that supports millimeter and centimeter wave communications.

SUMMARY

An electronic device may be provided with wireless circuitry. The wireless circuitry may include one or more antenna structures and transceiver circuitry such as millimeter wave transceiver circuitry. Antenna structures in the wireless circuitry may include co-located patch antennas that are organized in a phased antenna array.

The antenna structures may include first and second patch antennas. The first patch antenna may include a first patch antenna resonating element over a ground plane. The second patch antenna may include a second patch antenna resonating element that at least partially overlaps the first patch antenna resonating element. The first patch antenna resonating element may convey radio-frequency signals in a first frequency band higher than 10 GHz. The second patch antenna resonating element may convey radio-frequency signals in a second frequency band higher than 10 GHz. The first patch antenna resonating element may include a hole. A transmission line for the second patch antenna resonating element may include a conductive via extending through the hole. The first and second patch antenna resonating elements may each include two positive antenna feed terminals for conveying radio-frequency signals with orthogonal polarizations.

In one suitable arrangement, the conductive via may be coupled to a first end of a conductive trace between the first and second patch antenna resonating elements. A second end of the conductive trace may be coupled to a positive antenna feed terminal on the second patch antenna resonating element over an additional conductive via. The additional conductive via may be laterally offset from the conductive via extending through the hole to ensure that the second patch antenna resonating element is impedance matched to the transmission line. The hole may be located within a central region of the first patch antenna resonating element (e.g., a location at which the first patch antenna resonating element generates an electric field with minimum magnitude). This may allow the conductive via to pass through the hole without electromagnetically coupling to the first patch antenna resonating element, thereby ensuring that the first and second patch antennas as sufficiently isolated.

In another suitable arrangement, adjustable impedance matching circuits may be coupled to the antenna feeds for the first and second patch antennas. The first and second patch antennas may be embedded in a substrate. The impedance matching circuits may be mounted to a surface of the substrate and may be coupled to the antenna feeds over corresponding conductive matching vias. If desired, the impedance matching circuits may be formed in an integrated circuit mounted to the substrate. Impedance matching circuits in the integrated circuit may be coupled to radio-frequency ports of the integrated circuit. Control circuitry may adjust the impedance matching circuits to couple selected impedances to the antenna feeds that help to ensure that the first and second patch antennas are sufficiently isolated from each other.

DETAILED DESCRIPTION

Figure 1:
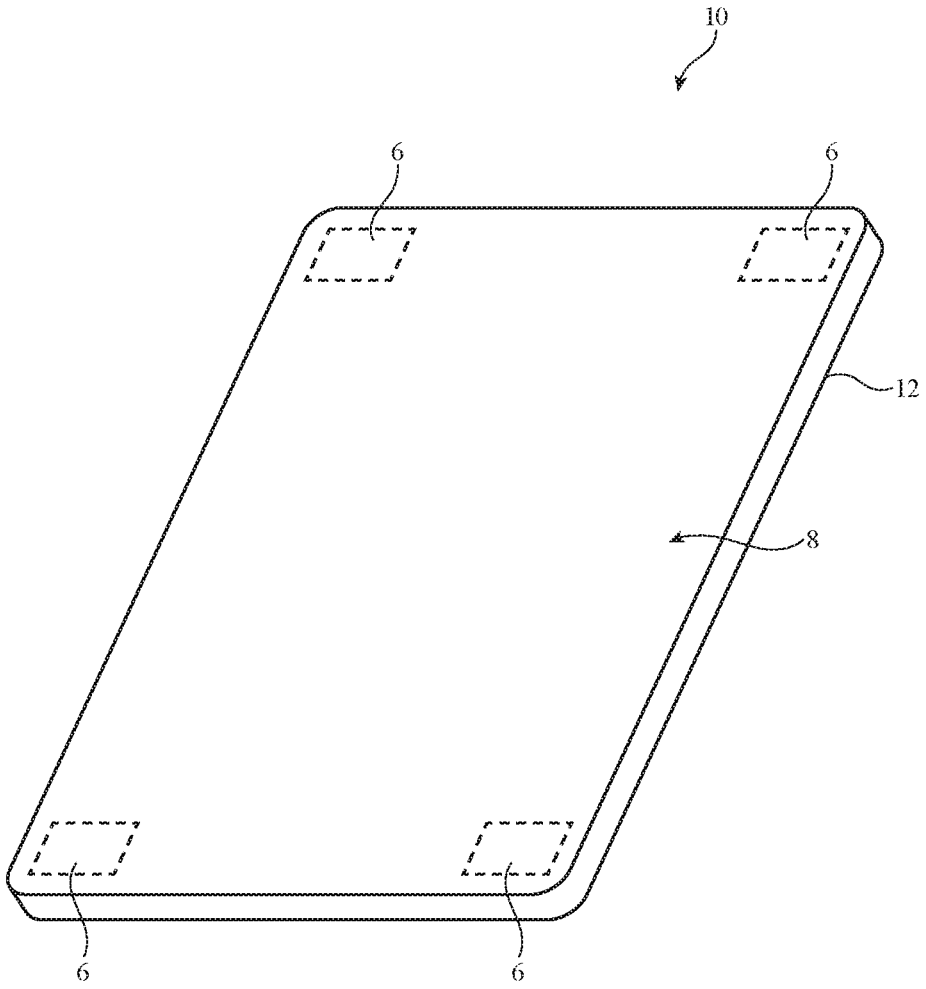
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 8. Display 8 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 8 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 8 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 8 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 8 (see, e.g., illustrative antenna locations 6 of FIG. 1). Display 8 may contain an active area with an array of pixels (e.g., a central rectangular portion). Inactive areas of display 8 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 6 of FIG. 1 and/or in corner locations on the rear of housing 12), along the peripheral edges of housing 12, on the rear of housing 12, under the display cover glass or other dielectric display cover layer that is used in covering and protecting display 8 on the front of device 10, under a dielectric window on a rear face of housing 12 or the edge of housing 12, or elsewhere in device 10.

Figure 2:
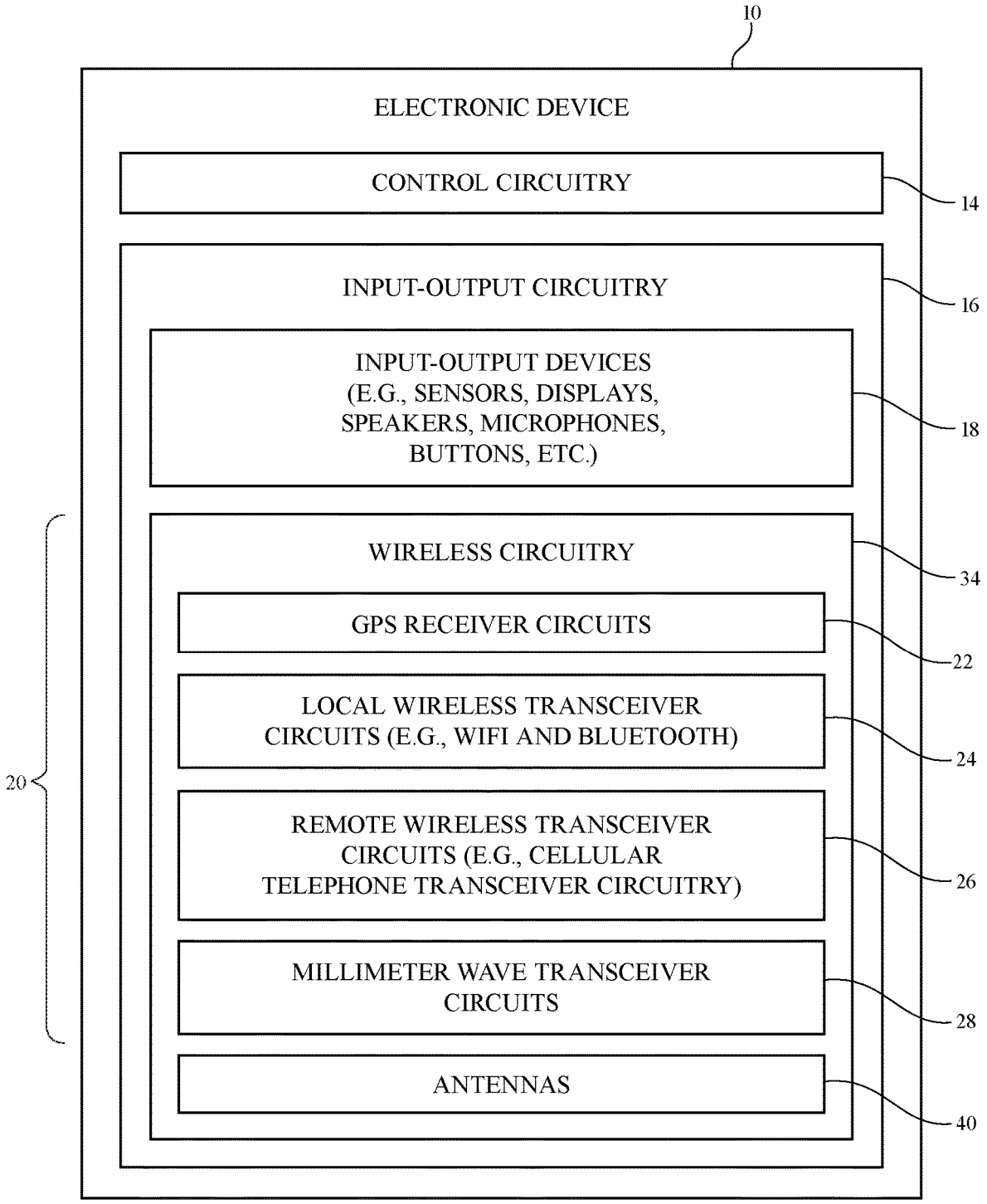
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network (WLAN) transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a communications band from 700 to 960 MHz, a communications band from 1710 to 2170 MHz, and a communications band from 2300 to 2700 MHz or other communications bands between 700 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or $5^{th}$ generation mobile networks or $5^{th}$ generation wireless systems (5G) communications bands between 27 GHz and 90 GHz. If desired, circuitry 28 may support communications at multiple frequency bands between 10 GHz and 300 GHz such as a first band from 27.5 GHz to 29.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals over short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can one or more antennas such as antennas arranged in one or more phased antenna arrays for handling millimeter and centimeter wave communications.

Transmission line paths may be used to route antenna signals within device 10. For example, transmission line paths may be used to couple antenna structures 40 to transceiver circuitry 20. Transmission lines in device 10 may include coaxial probes realized by metalized vias, microstrip transmission lines, stripline transmission lines, edge-coupled microstrip transmission lines, edge-coupled stripline transmission lines, waveguide structures, transmission lines formed from combinations of transmission lines of these types, etc. Transmission lines in device 10 may be integrated into rigid and/or flexible printed circuit boards. In one suitable arrangement, transmission lines in device 10 may also include transmission line conductors (e.g., signal and ground conductors) integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

In devices such as handheld devices, the presence of an external object such as the hand of a user or a table or other surface on which a device is resting has a potential to block wireless signals such as millimeter wave signals. Accordingly, it may be desirable to incorporate multiple antennas or phased antenna arrays into device 10, each of which is placed in a different location within device 10. With this type of arrangement, an unblocked antenna or phased antenna array may be switched into use. In scenarios where a phased antenna array is formed in device 10, once switched into use, the phased antenna array may use beam steering to optimize wireless performance. Configurations in which antennas from one or more different locations in device 10 are operated together may also be used.

Figure 3:
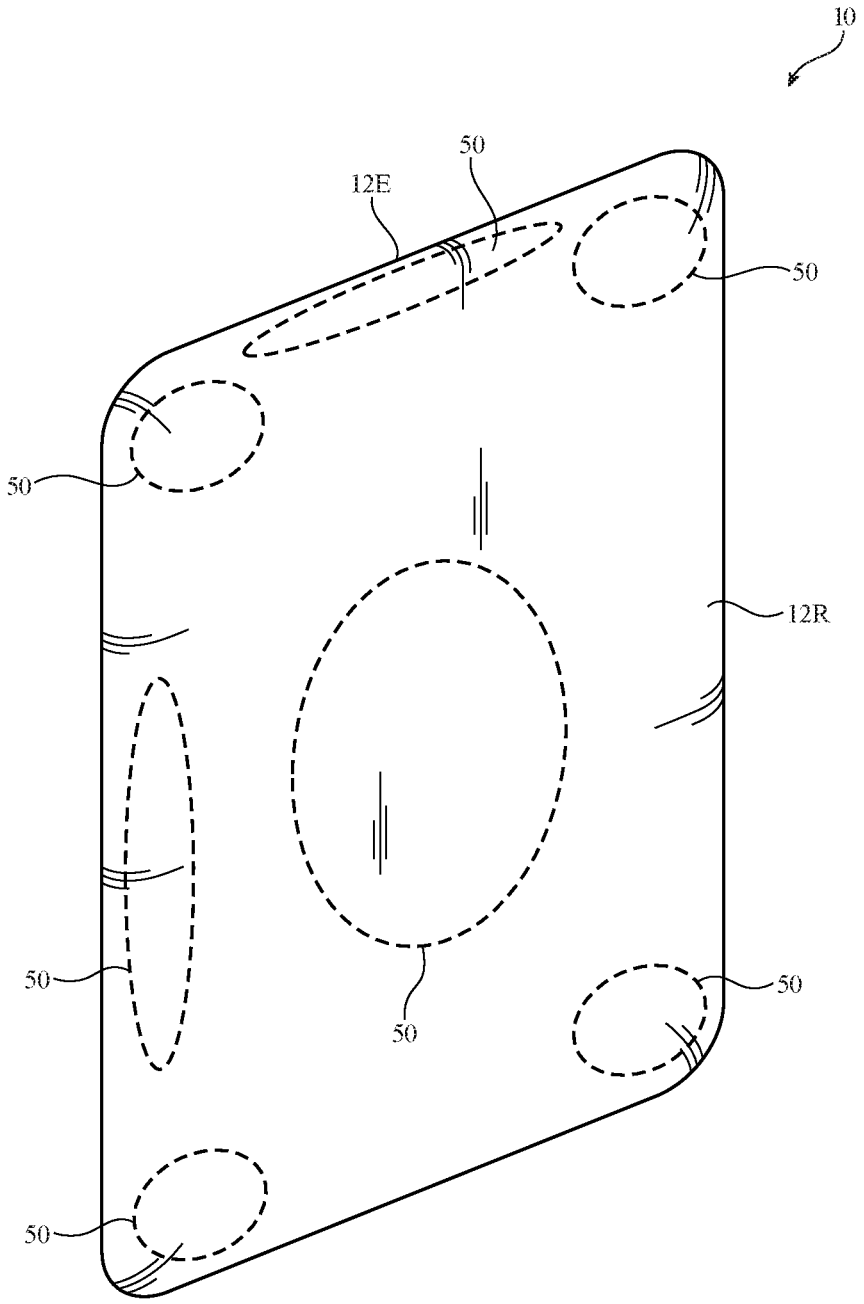
FIG. 3 is a rear perspective view of an illustrative electronic device showing illustrative locations at which antennas for communications at frequencies greater than 10 GHz may be located in accordance with an embodiment.

FIG. 3 is a rear perspective view of electronic device 10 showing illustrative locations 50 on the rear and sides of housing 12 in which antennas 40 (e.g., single antennas and/or phased antenna arrays for use with wireless circuitry 34 such as wireless transceiver circuitry 28) may be mounted in device 10. Antennas 40 may be mounted at the corners of device 10, along the edges of housing 12 such as edge 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment. In another suitable arrangement, antennas 40 may be mounted on the exterior of conductive portions of housing 12.

In devices with phased antenna arrays, circuitry 34 may include gain and phase adjustment circuitry that is used in adjusting the signals associated with each antenna 40 in an array (e.g., to perform beam steering). Switching circuitry may be used to switch desired antennas 40 into and out of use. If desired, each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
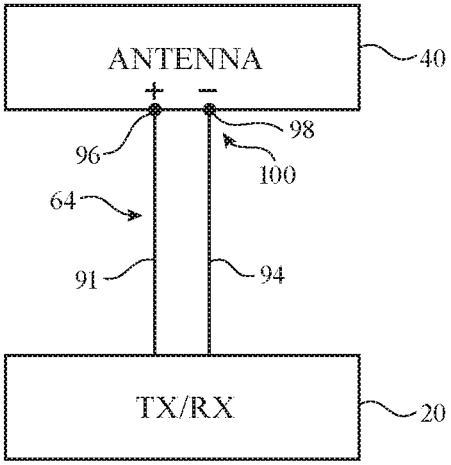
FIG. 4 is a diagram of an illustrative transceiver circuit and antenna in accordance with an embodiment.

A schematic diagram of an antenna 40 coupled to transceiver circuitry 20 (e.g., transceiver circuitry 28 of FIG. 2) is shown in FIG. 4. As shown in FIG. 4, radio-frequency transceiver circuitry 20 may be coupled to antenna feed 100 of antenna 40 using transmission line 64. Antenna feed 100 may include a positive antenna feed terminal such as positive antenna feed terminal 96 and may include a ground antenna feed terminal such as ground antenna feed terminal 98. Transmission line 64 may be formed form metal traces on a printed circuit or other conductive structures and may have a positive transmission line signal path such as path 91 that is coupled to terminal 96 and a ground transmission line signal path such as path 94 that is coupled to terminal 98. Path 91 may sometimes be referred to herein as signal conductor 91. Path 94 may sometimes be referred to herein as ground conductor 94.

Transmission line paths such as path 64 may be used to route antenna signals within device 10. For example, transmission line paths may be used to couple antenna structures such as one or more antennas in an array of antennas to transceiver circuitry 20. Transmission lines in device 10 may include coaxial probes realized by metal vias, microstrip transmission lines, stripline transmission lines, edge-coupled microstrip transmission lines, edge-coupled stripline transmission lines, waveguide structures, transmission lines formed from combinations of transmission lines of these types, etc. Transmission lines in device 10 may be integrated into rigid and/or flexible printed circuit boards.

In one suitable arrangement, transmission lines in device 10 may also include transmission line conductors (e.g., signal and ground conductors) integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). Filter circuitry, switching circuitry, impedance matching circuitry, and other circuitry may be interposed within transmission line 64 and/or circuits such as these may be incorporated into antenna 40 if desired (e.g., to support antenna tuning, to support operation in desired frequency bands, etc.).

Device 10 may contain multiple antennas 40. The antennas may be used together or one of the antennas may be switched into use while other antenna(s) are switched out of use. If desired, control circuitry 14 (FIG. 2) may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may be arranged in one or more antenna arrays (e.g., phased antenna arrays to implement beam steering functions). For example, the antennas that are used in handling millimeter and centimeter wave signals wireless transceiver circuits 28 may be implemented as phased antenna arrays. The radiating elements in a phased antenna array for supporting millimeter and centimeter wave communications may be patch antennas (e.g., stacked patch antennas), dipole antennas, dipole antennas with directors and reflectors in addition to dipole antenna resonating elements (sometimes referred to as Yagi antennas or beam antennas), or other suitable antenna elements. Transceiver circuitry can be integrated with the phased antenna arrays to form integrated phased antenna array and transceiver circuit modules.

Figure 5:
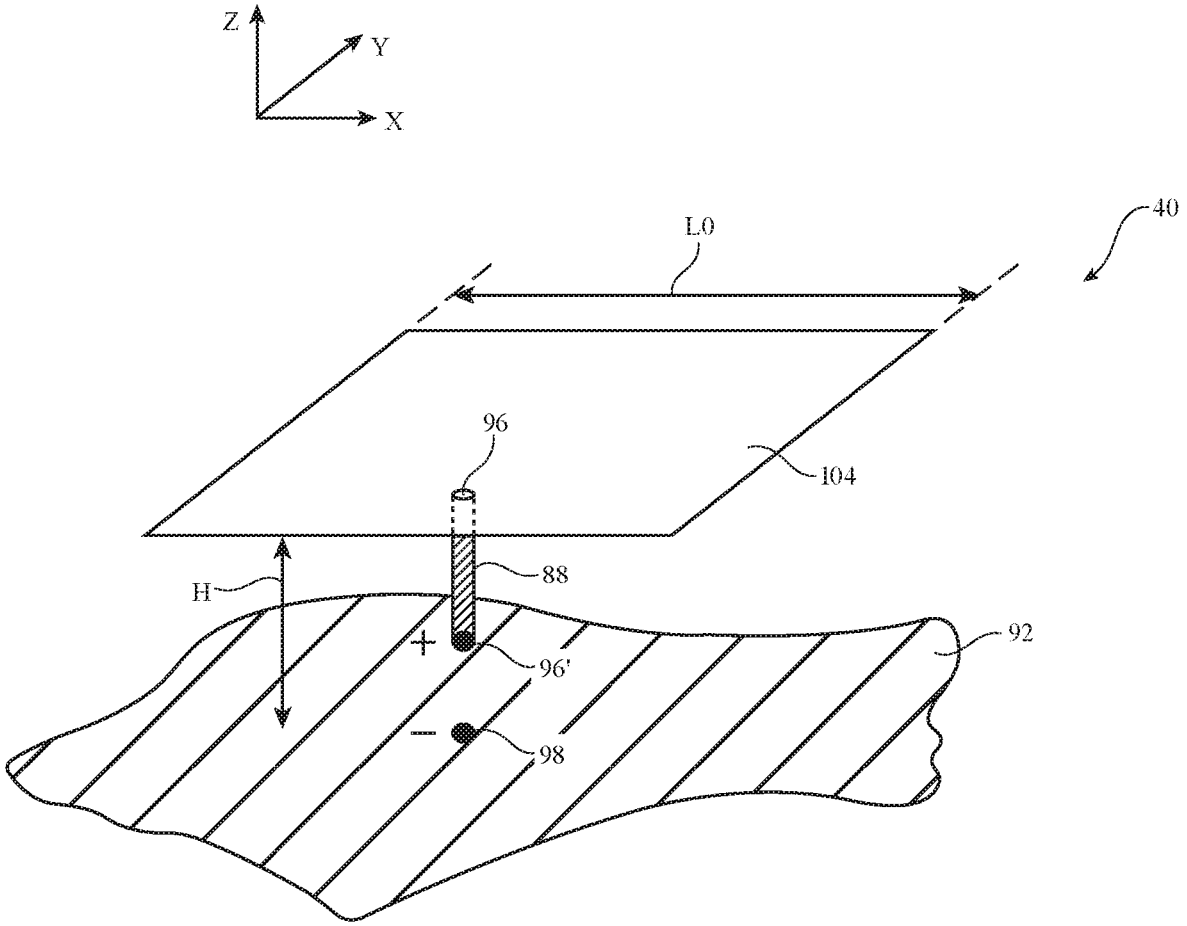
FIG. 5 is a perspective view of an illustrative patch antenna in accordance with an embodiment.

An illustrative patch antenna that may be used in conveying wireless signals at frequencies between 10 GHz and 300 GHz or other wireless signals is shown in FIG. 5. As shown in FIG. 5, antenna 40 may be a patch antenna having a patch antenna resonating element 104 that is separated from and parallel to a ground plane such as antenna ground plane 92. Positive antenna feed terminal 96 may be coupled to patch antenna resonating element 104. Ground antenna feed terminal 98 may be coupled to ground plane 92. If desired, conductive path 88 (e.g., a coaxial probe feed) may be used to couple terminal 96' to terminal 96 so that antenna 40 is fed using a transmission line with a positive conductor coupled to terminal 96' and thus terminal 96. If desired, path 88 may be omitted and other types of antenna feed arrangements may be used. The illustrative feeding configuration of FIG. 5 is merely illustrative.

As shown in FIG. 5, patch antenna resonating element 104 may lie within a plane such as the X-Y plane of FIG. 5 (e.g., the lateral surface area of element 104 may lie in the X-Y plane). Patch antenna resonating element 104 may sometimes be referred to herein as patch 104, patch element 104, patch resonating element 104, antenna resonating element 104, or resonating element 104. Ground plane 92 may lie within a plane that is parallel to the plane of patch 104. Patch 104 and ground plane 92 may therefore lie in separate parallel planes that are separated by a distance H. Patch 104 and ground plane 92 may be formed from conductive traces patterned on a dielectric substrate such as a rigid or flexible printed circuit board substrate, metal foil, stamped sheet metal, electronic device housing structures, or any other desired conductive structures. The length of the sides of patch 104 may be selected so that antenna 40 resonates at a desired operating frequency. For example, the sides of patch 104 may each have a length L0 that is approximately equal to half of the wavelength (e.g., within 15% of half of the wavelength) of the signals conveyed by antenna 40 (e.g., in scenarios where patch 104 is substantially square).

The example of FIG. 5 is merely illustrative. Patch 104 may have a square shape in which all of the sides of patch 104 are the same length or may have a different rectangular shape (e.g., a non-square rectangular shape). If desired, patch 104 and ground plane 92 may have different shapes and orientations (e.g., planar shapes, curved patch shapes, patch shapes with non-rectangular outlines, shapes with straight edges such as squares, shapes with curved edges such as ovals and circles, shapes with combinations of curved and straight edges, etc.). In scenarios where patch 104 is non-rectangular, patch 104 may have a side or a maximum lateral dimension that is approximately equal to (e.g., within 15% of) half of the wavelength of operation, for example.

Figure 6:
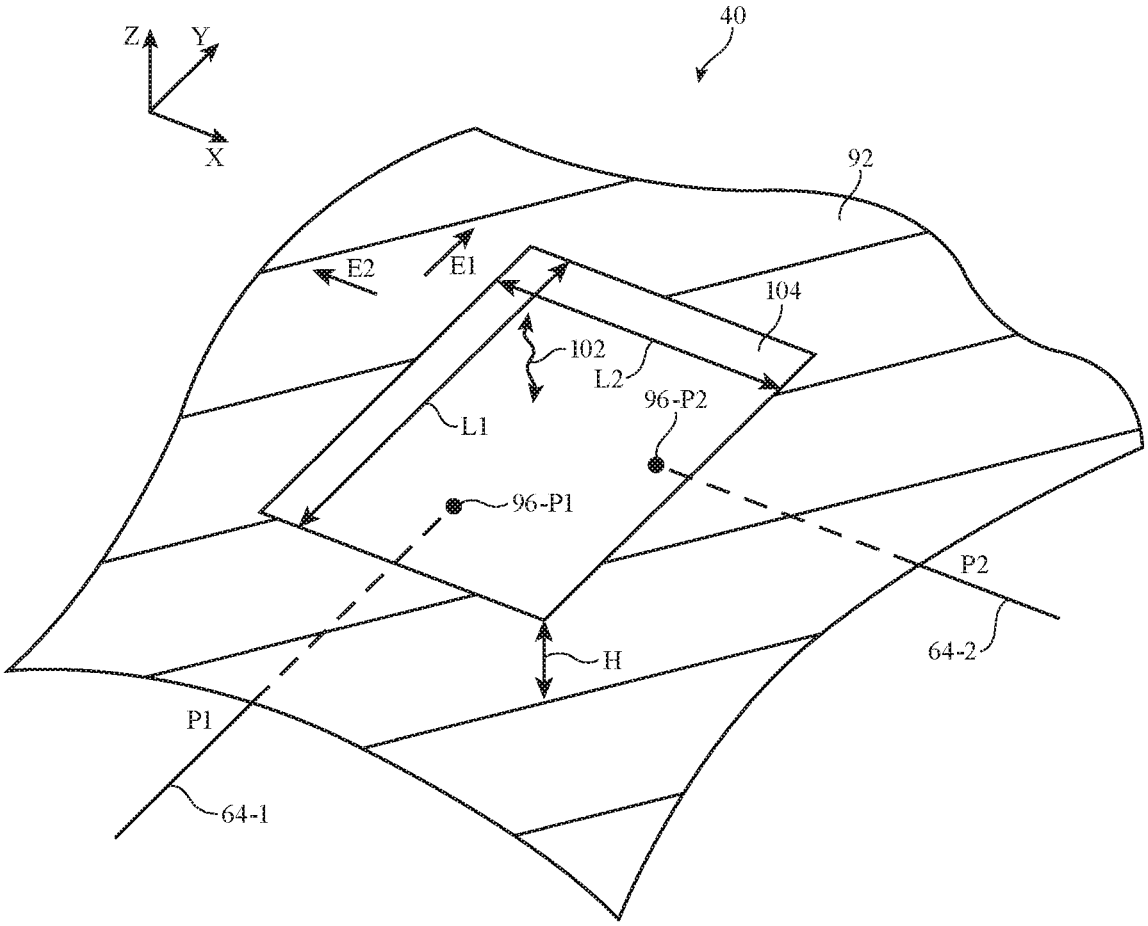
FIG. 6 is a perspective view of an illustrative patch antenna with dual ports in accordance with an embodiment.

To enhance the polarizations handled by antenna 40, antenna 40 may be provided with multiple feeds. An illustrative patch antenna with multiple feeds is shown in FIG. 6. As shown in FIG. 6, antenna 40 may have a first feed at antenna port P1 that is coupled to transmission line 64-1 and a second feed at antenna port P2 that is coupled to transmission line 64-2. The first antenna feed may have a first ground feed terminal coupled to antenna ground 92 and a first positive antenna feed terminal 96-P1 coupled to patch 104. The second antenna feed may have a second ground feed terminal coupled to ground plane 92 and a second positive antenna feed terminal 96-P2 on patch 104.

Patch 104 may have a rectangular shape with a first pair of edges running parallel to dimension Y and a second pair of perpendicular edges running parallel to dimension X, for example. The length of patch 104 in dimension Y is L1 and the length of patch 104 in dimension X is L2. With this configuration, antenna 40 may be characterized by orthogonal polarizations.

When using the first antenna feed associated with port P1, antenna 40 may transmit and/or receive antenna signals in a first communications band at a first frequency (e.g., a frequency at which one-half of the corresponding wavelength is approximately equal to dimension L1). These signals may have a first polarization (e.g., the electric field E1 of antenna signals 102 associated with port P1 may be oriented parallel to dimension Y). When using the antenna feed associated with port P2, antenna 40 may transmit and/or receive antenna signals in a second communications band at a second frequency (e.g., a frequency at which one-half of the corresponding wavelength is approximately equal to dimension L2). These signals may have a second polarization (e.g., the electric field E2 of antenna signals 102 associated with port P2 may be oriented parallel to dimension X so that the polarizations associated with ports P1 and P2 are orthogonal to each other). In scenarios where patch 104 is square (e.g., length L1 is equal to length L2), ports P1 and P2 may cover the same communications band. In scenarios where patch 104 is rectangular, ports P1 and P2 may cover different communications bands if desired. During wireless communications using device 10, device 10 may use port P1, port P2, or both port P1 and P2 to transmit and/or receive signals (e.g., millimeter wave signals at millimeter wave frequencies).

The example of FIG. 6 is merely illustrative. Patch 104 may have a square shape in which all of the sides of patch 104 are the same length or may have a rectangular shape in which length L1 is different from length L2. In general, patch 104 and ground plane 92 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.).

If care is not taken, antennas 40 such as single-polarization patch antennas of the type shown in FIG. 5 and/or dual-polarization patch antennas of the type shown in FIG.

6 may have insufficient bandwidth for covering an entirety of a communications band of interest (e.g., a communications band at frequencies greater than 10 GHz). If desired, antenna 40 may include one or more parasitic antenna resonating elements that serve to broaden the bandwidth of antenna 40. The parasitic antenna resonating element may be formed from one or more patches over patch 104. The length of the parasitic antenna resonating element may be greater than or less than the length of patch 104 to add additional resonances that broaden the bandwidth of the antenna. The parasitic antenna resonating element may have a cross shape for impedance matching if desired.

Antennas 40 such as single-polarization patch antennas of the type shown in FIG. 5 and/or dual-polarization patch antennas of the type shown in FIG. 6 may be arranged within a corresponding phased antenna array in device 10 if desired. In practice, it may be desirable for antennas 40 within device 10 to be able to provide coverage in multiple communications bands between 10 GHz and 300 GHz. As examples, the communications bands may include millimeter and/or centimeter wave frequencies from 27.5 GHz to 28.5 GHz, from 26 GHz to 30 GHz, from 20 to 36 GHz, from 37 GHz to 41 GHz, from 36 GHz to 42 GHz, from 30 GHz to 56 GHz, from 57 GHz to 71 GHz, from 58 GHz to 63 GHz, from 59 GHz to 61 GHz, from 42 GHz to 71 GHz, or any other desired bands of frequencies between 10 GHz and 300 GHz. In one suitable arrangement that is described herein as an example, it may be desirable for the antennas to cover both a first communications band between 27.5 and 29.5 GHz and a second communications band between 37 GHz to 41 GHz. Patch 104 as shown in FIGS. 5 and 6 may have insufficient bandwidth to cover the entirety of the frequency range between 27.5 GHz and 41 GHz.

In some scenarios, a first antenna for covering the first communications band is formed at a first location and a second antenna for covering the second communications band is formed at a second location in the electronic device (e.g., first and second locations on opposing sides of the device). While a relatively large separation between the two antennas may enhance isolation between the antennas, forming the antennas at separate locations may occupy an excessive amount of the limited space within device 10. In order to reduce the amount of space required within device 10 for covering both the first and second frequency bands, the first antenna may be co-located with the second antenna in device 10. First and second antennas 40 may be considered to be co-located within device 10 when at least some of the patch 104 of the first antenna overlaps the outline or footprint (lateral area) of the patch 104 in the second antenna. Co-locating the antennas in this way may optimize the amount of space required by the antennas in device 10 for covering both the first and second communications bands.

Figure 7:
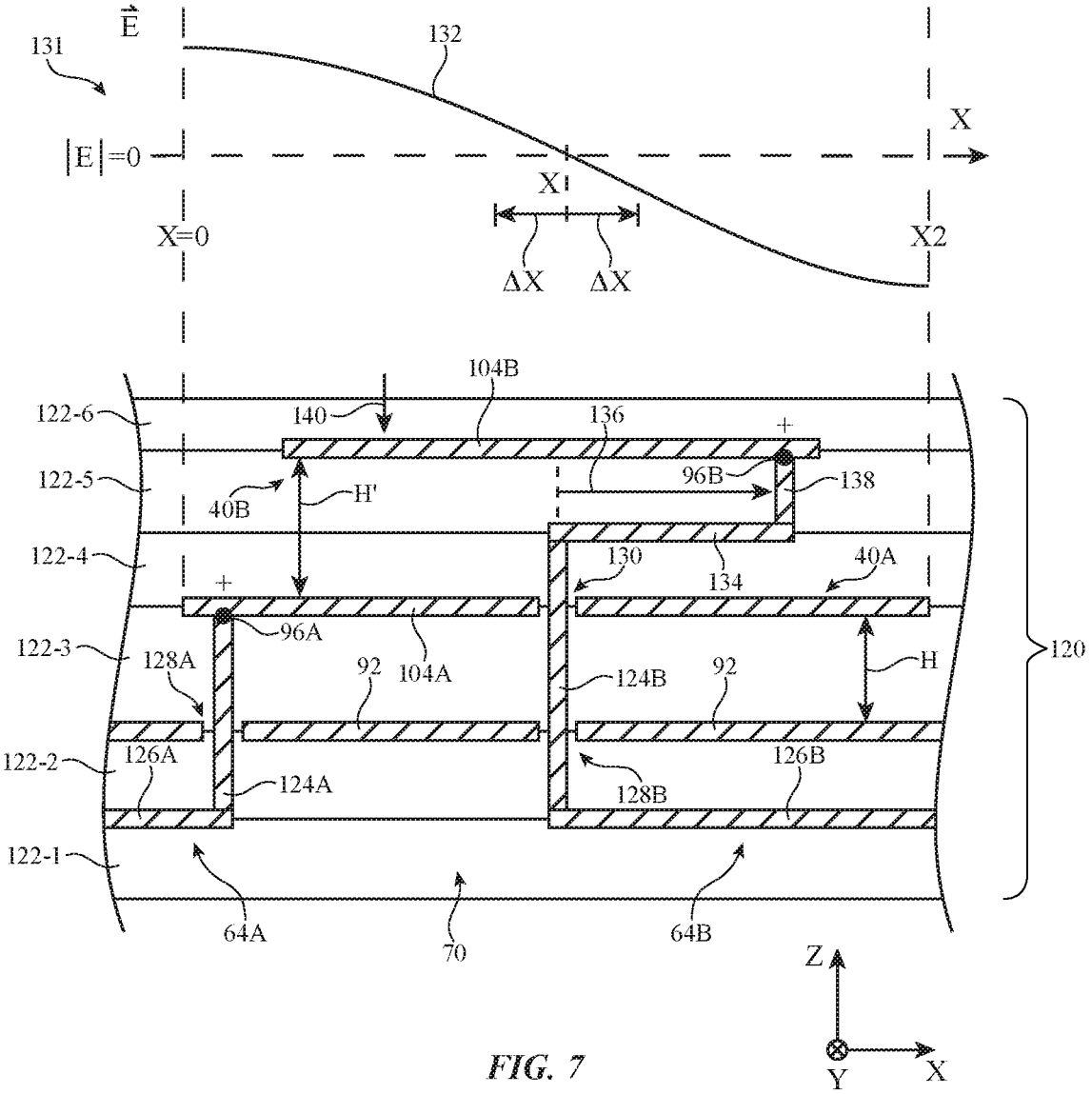
FIG. 7 is a cross-sectional side view of illustrative multi-band antenna structures having co-located patch antennas with isolated feeds in accordance with an embodiment.

FIG. 7 is a cross-sectional side view showing how a first antenna for covering the first communications band may be co-located with a second antenna for covering the second communications band. As shown in FIG. 7, antenna structures 70 may include a first antenna 40 such as antenna 40A and a second antenna 40 such as antenna 40B. Antenna 40A may cover the first communications band whereas antenna 40B covers the second communications band. Antenna structures 70 may collectively cover both the first and second communications bands. The second communications band covered by antenna 40B may include higher frequencies (e.g., frequencies between 37 GHz and 41 GHz) than the first communications band covered by antenna 40A (e.g., frequencies between 27.5 GHz and 29.5 GHz), for example.

In the example of FIG. 7, antenna 40A is a patch antenna such as the single-polarization patch antenna shown in FIG. 5 or the dual-polarization patch antenna shown in FIG. 6. Similarly, antenna 40B is a patch antenna such as the single-polarization patch antenna shown in FIG. 5 or the dual-polarization patch antenna shown in FIG. 6. This is merely illustrative and, if desired, antennas 40A and 40B may be formed using other antenna structures. Antenna structures 70 may sometimes be referred to herein as antenna system 70, multi-band antenna system 70, dual-band antenna system 70, multi-band antenna structures 70, patch antenna structures 70, multi-band patch antenna structures 70, co-located patch antenna structures 70, or co-located antenna structures 70. Antennas 40A and 40B may sometimes be referred to collectively herein as co-located antennas or co-located patch antennas 40A and 40B.

As shown in FIG. 7, patch antenna 40A may include patch 104A, ground plane 92, and an antenna feed that includes a positive antenna feed terminal 96A coupled to patch 104A and a corresponding ground antenna feed terminal coupled to ground plane 92. Patch antenna 40B may include patch 104B, ground plane 92, and an antenna feed that includes a positive antenna feed terminal 96B coupled to patch 104B and a corresponding ground antenna feed terminal coupled to ground plane 92.

Patch 104A may have a lateral surface extending in the X-Y plane of FIG. 7 and may be separated from antenna ground plane 92 by distance H (e.g., the lateral surface of patch 104A may extend parallel to the lateral surface of ground plane 92). Patch 104B may have a lateral surface extending in the X-Y plane and may be separated from patch 104A by distance H' (e.g., the lateral surface of patch 104B may extend parallel to the lateral surface of ground plane 92 and patch 104A). Distance H' may be the same as distance H, less than distance H, or greater than distance H (e.g., patch 104B may be separated from ground plane 92 by distance H+H'). Distances H and H' may be between 0.1 mm and 10 mm, as examples. In general, adjusting distances H and H' may serve to adjust the bandwidth of antennas 40A and 40B, respectively.

Antennas 40A and 40B may be formed on a dielectric substrate such as substrate 120. Substrate 120 may be, for example, a rigid or printed circuit board or other dielectric substrate. Substrate 120 may include multiple dielectric layers 122 (e.g., multiple layers ceramic or multiple layers of printed circuit board substrate such fiberglass-filled epoxy). Dielectric layers 122 may include a first dielectric layer 122-1, a second dielectric layer 122-2 over the first dielectric layer, a third dielectric layer 122-3 over the second dielectric layer, a fourth dielectric layer 122-4 over the third dielectric layer, a fifth dielectric layer 122-5 over the fourth dielectric layer, and a sixth dielectric layer 122-6 over the fifth dielectric layer. Additional dielectric layers 122 may be stacked within substrate 120 if desired.

With this type of arrangement, antenna 40A may be embedded within the dielectric layers of substrate 120. For example, ground plane 92 may be formed on a surface of second dielectric layer 122-2 whereas patch 104A is formed on a surface of third dielectric layer 122-3. Antenna 40A may be fed using a first transmission line such as transmission line 64A. Transmission line 64A may, for example, be formed from a conductive trace such as conductive trace 126A on dielectric layer 122-1 and portions of ground plane 92. Conductive trace 126A may form the signal conductor for transmission line 64A (e.g., signal conductor 91 of FIG. 3). A first hole 128A may be formed in ground plane 92. First transmission line 64A may include a vertical conductive through-via 124A that extends from trace 126A through dielectric layer 122-2, hole 128A in ground plane 92, and dielectric layer 122-3 to positive antenna feed terminal 96A on patch 104A. This example is merely illustrative and, if desired, other transmission line structures may be used (e.g., coaxial cable structures, stripline transmission line structures, etc.).

Patch antenna 40B may be embedded within the layers of substrate 120. For example, patch 104B may be formed on a surface of dielectric layer 122-5. Some or all of the lateral area of patch 104B may overlap with the outline (footprint) of patch 104A (in the X-Y plane). Antenna 40B may be fed using a second transmission line such as transmission line 64B. Transmission line 64B may, for example, be formed from a conductive trace such as conductive trace 126B on dielectric layer 122-1 and portions of ground plane 92. Conductive trace 126B may form the positive signal conductor for transmission line 64B (e.g., signal conductor 91 of FIG. 3).

A second hole 128B may be formed in ground plane 92. A hole 130 may be formed in patch 104A. Second transmission line 64B may include a vertical conductive through via 124B that extends from trace 126B through dielectric layer 122-2, hole 128B in ground plane 92, dielectric layer 122-3, hole 130 in patch 104A, and dielectric layer 122-4 to a first end of conductive trace 134 on dielectric layer 122-4. An opposing second end of conductive trace 134 may be coupled to positive antenna feed terminal 96B on patch 104B by a vertical conductive through-via 138 extending through dielectric layer 122-5. Conductive trace 134 may sometimes be referred to herein as feed trace 134, signal conductor trace 134, horizontal feed trace 134, or horizontal trace 134.

In this way, ground plane 92, trace 126B, conductive via 124B, horizontal trace 134, and conductive via 138 may form part of transmission line 64B for antenna 40B (e.g., the signal conductor for transmission line 64B may include trace 126B, conductive via 124B, horizontal trace 134, and conductive via 138). Horizontal trace 134 may have a length 136 extending from the first end of the horizontal trace to the second end of the horizontal trace (e.g., conductive via 138 may be laterally offset from conductive via 124B by length 136).

The example of FIG. 7 is merely illustrative and, if desired, conductive vias 124A, 124B, and/or 138 may be replaced by any desired vertical conductive structures (e.g., metal pillars, metal wire, conductive pins, or other vertical conductive interconnect structures). If desired, other transmission line structures may be used (e.g., coaxial cable structures, stripline transmission line structures, etc.). Traces 126A and 126B may be formed on different dielectric layers 122 if desired. Conductive vias 124A and 124B may extend through the same hole in ground plane 92 if desired. Holes 128A, 128B, and 130 may sometimes be referred to herein as notches, gaps, openings, or slots. If desired, antenna 40B may include one or more parasitic antenna resonating elements that serve to broaden the bandwidth of antenna 40B (e.g., parasitic antenna resonating elements formed from one or more layers of conductive traces over patch 104B).

If desired, additional dielectric layers 122 may be interposed between traces 126A and 126B and ground plane 92, between ground plane 92 and patch 104A, between patch 104A and patch 104B, between patch 104A and horizontal trace 134, between horizontal trace 134 and patch 104B, and/or over patch 104B. In another suitable arrangement, substrate 120 may be formed from a single dielectric layer (e.g., antennas 40A and 40B may be embedded within a single dielectric layer such as a molded plastic layer). In yet another suitable arrangement, substrate 120 may be omitted and antennas 40A and 40B may be formed on other substrate structures or may be formed without substrates.

In practice, while patch 104B covers relatively high frequencies, patch 104B may have insufficient bandwidth for covering relatively low frequencies (e.g., patch 104B alone may not have sufficient bandwidth to cover an entirety of the frequency range from 27.5 GHz to 41 GHz). Patch 104B may have a length (e.g., lengths L1 and/or L2 of FIG. 6 and measured parallel to the X-axis of FIG. 7) that configures antenna 40B to radiate within a relatively high communications band such as a communications band between 37 GHz and 41 GHz. Patch 104A may have a greater length that configures antenna 40A to radiate within a relatively low communications band such as the communications band between 27.5 and 29.5 GHz. Collectively, antennas 40A and 40B may cover frequencies within both communications bands.

The electric field generated by antenna 40A varies across the length of patch 104A. As shown in FIG. 7, graph 131 plots the electric field distribution of antenna 40A as a function location X across the length of patch 104A (e.g., parallel to the X-axis of FIG. 7). The left edge of patch 104A corresponds to a position of X=0 whereas the right edge of patch 104A corresponds to a position of X=X2. X2 may be approximately equal to one-half of the wavelength corresponding to a frequency in the communications band covered by antenna 40A (e.g., a frequency between 27.5 and 29.5 GHz). Curve 132 represents the electric field generated by antenna 40A across the length of patch 104A. As shown by curve 132, antenna 40A generates a maximum electric field magnitude (density) at the left edge (X=0) and at the right edge (X=X2) of patch 104A. At location X=X1, antenna 40A generates an electric field having zero magnitude. Location X=X1 may be located at the center of patch 104B (e.g., X1 may be equal to X2/2 and one-quarter of the wavelength of operation of antenna 40A).

If care is not taken, it can be difficult to ensure that co-located antennas such as antennas 40A and 40B are sufficiently isolated. In some scenarios, a single conductive via is used to couple trace 126B to positive antenna feed terminal 96B. This conductive via extends through aligned openings in ground plane 92 and patch 104A (e.g., openings aligned with the location of positive antenna feed terminal 96B near the right edge of patch 104B of FIG. 7). In these scenarios, the high-magnitude electric field generated by antenna 40A near the right edge of patch 104A (e.g., as illustrated by curve 132) electromagnetically couples with the conductive via as the conductive via extends through patch 104A. This electromagnetic cross-coupling can limit the isolation between antennas 40A and 40B, leading to a reduction in antenna efficiency for antennas 40A and 40B and/or errors in the conveyed radio-frequency signals.

In order to minimize coupling between the feed path for antenna 40B and the underlying antenna 40A, conductive via 124B may extend through patch 104A at a location for which the magnitude of the electric field generated by antenna 40A is minimal (e.g., zero). As shown in FIG. 7, hole 130 is aligned with location X=X1 at the center of patch 104A. This allows conductive via 124B to extend through patch 104A at a location where the electric field generated by antenna 40A has a minimum magnitude, thereby minimizing electromagnetic coupling onto the conductive via from patch 104A.

Locating positive antenna feed terminal 96B at location X=X1 on patch 104B may lead to an impedance mismatch between patch 104B and transmission line 64B. Horizontal trace 134 may allow conductive via 124B to be coupled to patch 104B (e.g., over conductive via 138 and positive antenna feed terminal 96B) at a suitable location for matching the impedance of patch 104B to the impedance of transmission line 64B. Length 136 may be selected to ensure that patch 104B is impedance matched to transmission line 64B. As an example, location X=X1 may correspond to a zero ohm impedance, location X=X2 may correspond to an infinite impedance, and length 136 may correspond to a location at which patch 104B exhibits a 50 ohm impedance (e.g., an impedance that matches the impedance of transmission line 64B). In this way, antenna 40B may be provided with suitable impedance matching (thereby maximizing antenna efficiency for antenna 40B) without introducing undesirable electromagnetic coupling associated with passing the signal conductor for transmission line 64B through patch 104A.

In the example of FIG. 7, antennas 40A and 40B are shown as each having only a single feed for the sake of simplicity. In order to enhance the polarizations covered by antenna structures 70, antennas 40A and/or 40B may be dual-polarized patch antennas that each have two corresponding feeds (e.g., as shown in FIG. 6, such that antenna structures 70 have a combined total of four antenna feeds), suitable geometry, and suitable phasing of ports P1 and P2.

If desired, hole 130 and conductive via 124B may be located within a distance ΔX from the exact center of patch 104B (i.e., location X=X1). Offsetting hole 130 from location X=X1 may allow patch 104A to accommodate two openings that pass two conductive vias for handling both horizontal and vertical polarizations. In general, locating the openings for both polarizations farther apart increases the isolation between polarizations for antenna 40B. Some amount of electromagnetic coupling onto the conductive vias may be sacrificed in order to accommodate multiple polarizations with satisfactory isolation between polarizations, if desired. In other words, hole 130 may be located within a central region of patch 104B defined by two-times distance ΔX around location X=X1. This central region (e.g., 2*ΔX) may be 25% of the length of patch 104B, 20% of the length of patch 104B, 15% of the length of patch 104B, 10% the length of patch 104B, or less than 10% of the length of patch 104B, as examples. Holes 130 in patch 104A and conductive vias 124 extending through patch 104A may sometimes be referred to as being located at or adjacent to the center of patch 104A when located within two times distance ΔX around location X=X1.

Figure 8:
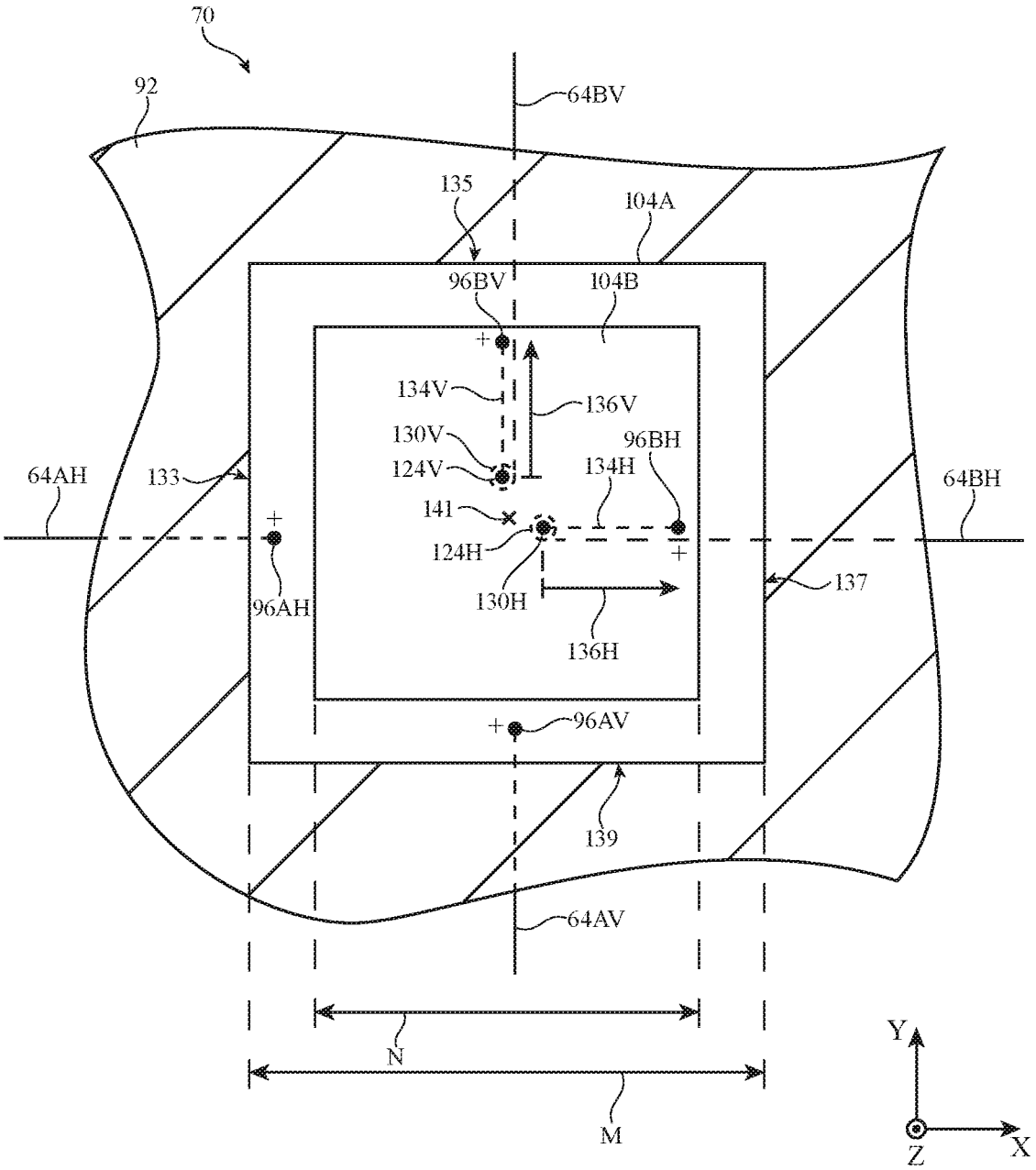
FIG. 8 is a top-down view of illustrative multi-band antenna structures having co-located patch antennas with isolated feeds in accordance with an embodiment.

FIG. 8 is a top-down view (as taken in the direction of arrow 140 of FIG. 7) showing how patch antennas 40A and 40B may each have two feeds (e.g., for covering multiple or non-linear polarizations). In the example of FIG. 8, dielectric substrate 120 is not shown for the sake of clarity.

As shown in FIG. 8, antenna 40A may have a first feed that is coupled to a first transmission line 64AV and a second feed that is coupled to a second transmission line 64AH. The first feed may include a first ground feed terminal coupled to ground plane 92 and a first positive antenna feed terminal 96AV coupled to patch 104A at a first location on patch 104A. The second antenna feed may include a second ground feed terminal coupled to ground plane 92 and a second positive antenna feed terminal 96AH coupled to patch 104A at a second location on patch 104A. For example, first positive antenna feed terminal 96AV may be located adjacent to a first side (edge) 139 of antenna structures 70 (e.g., approximately halfway across patch 104A), whereas second positive antenna feed terminal 96AH is located adjacent to a second side 133 of antenna structures 70 (e.g., approximately halfway across patch 104A).

Antenna 40B may have a third feed that is coupled to a third transmission line 64BV and a fourth feed that is coupled to a fourth transmission line 64BH. The third feed may include a third ground feed terminal coupled to ground plane 92 and a third positive antenna feed terminal 96BV coupled to patch 104B at a first location on patch 104B (e.g., adjacent to side 135 of antenna structures 70 approximately halfway across patch 104B). The fourth antenna feed may include a fourth ground feed terminal coupled to ground plane 92 and a fourth positive antenna feed terminal 96BH coupled to patch 104B at a second location on patch 104B (e.g., adjacent to side 137 of antenna structures 70 approximately halfway across patch 104B).

Positive antenna feed terminals 96AH and 96BH may handle radio-frequency signals of a first polarization (e.g., horizontally-polarized signals). Positive antenna feed terminals 96AV and 96BV may handle radio-frequency signals of a second polarization (e.g., vertically-polarized signals). Locating positive antenna feed terminals 96AH and 96BH at opposing sides of antenna structures 70 may help to maximize isolation between the horizontally-polarized signals conveyed by each positive antenna feed terminal. Similarly, locating positive antenna feed terminals 96AV and 96BV at opposing sides of antenna structures 70 may help to maximize isolation between the vertically-polarized signals conveyed by each positive antenna feed terminal.

One or more holes 130 (FIG. 7) may be provided in patch 104A to accommodate positive antenna feed terminals 96BV and 96BH on patch 104B. In the example of FIG. 8, a first hole 130V is formed at the center of patch 104A for accommodating positive antenna feed terminal 96BV and a second hole 130H is formed at the center of patch 104A for accommodating positive antenna feed terminal 96BH. Transmission line 64BV may include a first vertical conductive via 124V extending through hole 130V and a horizontal trace 134V that couples first vertical conductive via 124V to positive antenna feed terminal 96BV over a second conductive via (e.g., a conductive via such as via 138 of FIG. 7). Similarly, transmission line 64BH may include a first vertical conductive via 124H extending through hole 130H and a horizontal trace 134H that couples first vertical conductive via 124H to positive antenna feed terminal 96BH over a second conductive via (e.g., a conductive via such as via 138 of FIG. 7).

Horizontal trace 134V may have length 136V (e.g., positive antenna feed terminal 96BV may be offset from center 141 of patch 104B by length 136V). Horizontal trace 134H may have length 136H (e.g., positive antenna feed terminal 96BH may be offset from center 141 by length 136H). Lengths 136V and 136H may be selected to ensure that patch 104B is impedance matched to transmission lines 64BV and 64BH, respectively.

In one suitable arrangement, conductive vias 124V and 124H extend through the same hole in patch 104A (e.g., a hole located at center 141 of patch 104A). In the example of FIG. 8, hole 130V and hole 130H are each offset from the center 141 of patch 104A (e.g., within distance ΔX as shown in FIG. 7 from center 141) to ensure that conductive via 124V is sufficiently isolated from conductive via 124H. By passing conductive vias 124H and 124V through the central region of patch 104A (e.g., within distance ΔX as shown in FIG. 7 from center 141), electromagnetic coupling onto the conductive vias from patch 104A may be minimized or eliminated.

As shown in FIG. 8, patch 104B has length N (e.g., a length that is approximately equal to one-half of the wavelength corresponding to a frequency between 37 GHz and 41 GHz) and patch 104A has length M (e.g., a length that is approximately equal to one-half of the wavelength corresponding to a frequency between 27.5 GHz and 29.5 GHz). In the example of FIG. 8, patches 104A and 104B are both square patches oriented in the same direction and centered on the same point. This is merely illustrative and, in other scenarios, patches 104A and 104B may have other shapes or orientations.

If desired, each positive antenna feed terminal on patch 104B may be fed using a conductive via that passes through locations on patch 104A that are outside of the central region of patch 104A (e.g., located beyond distance ΔX from center 141). In these scenarios, horizontal traces 134 may be omitted and antenna structures 70 may include adjustable impedance matching circuits to ensure that antennas 40A and 40B are sufficiently isolated.

Figure 9:
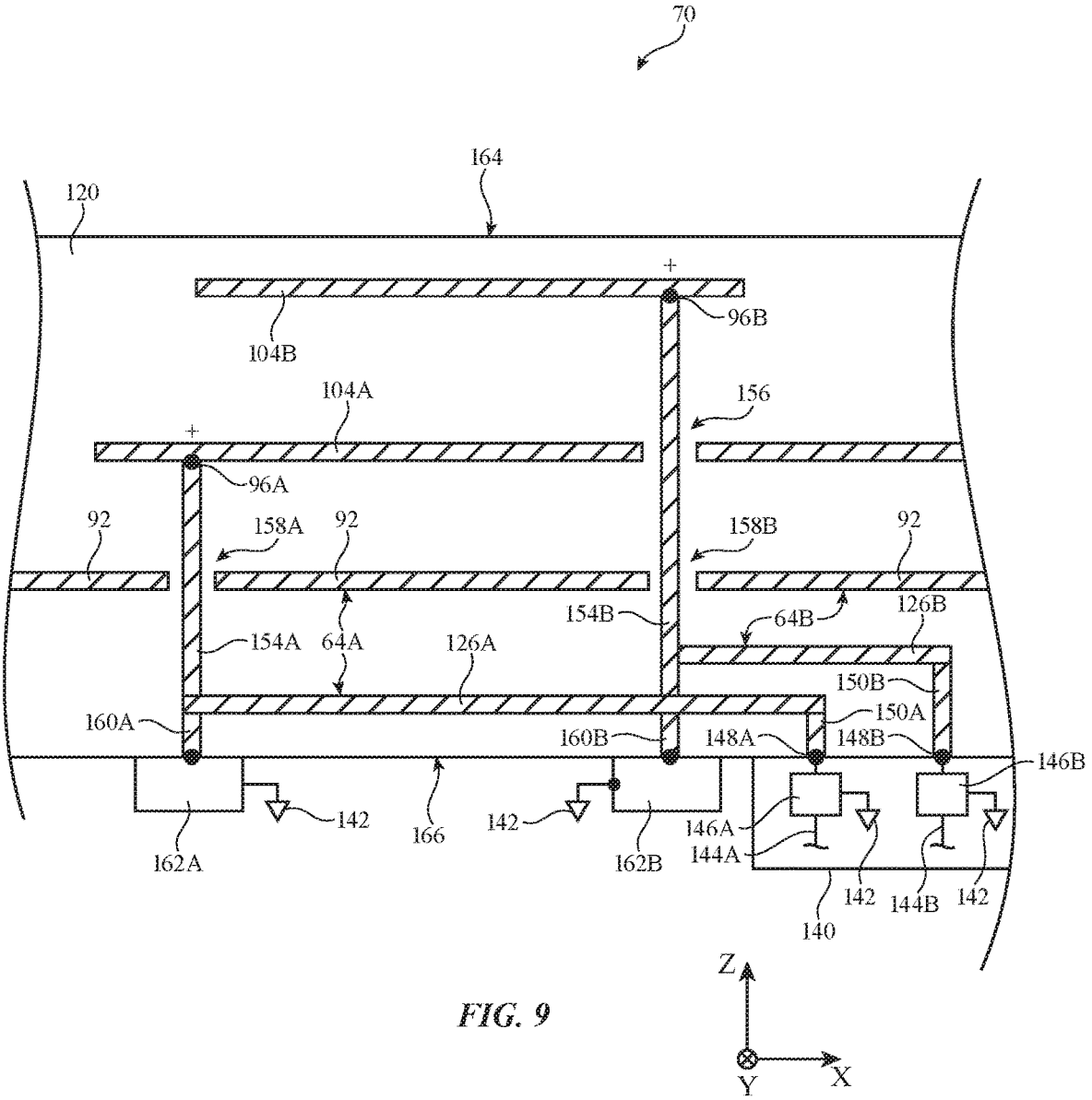
FIG. 9 is a cross-sectional side view showing how adjustable matching circuits may be provided for multi-band antenna structures having co-located patch antennas to enhance feed isolation in accordance with an embodiment.

FIG. 9 is a cross-sectional side view of antenna structures 70 having adjustable impedance matching circuits for ensuring that antennas 40A and 40B are sufficiently isolated. In the example of FIG. 9, dielectric layers 122 of substrate 120 are omitted for the sake of clarity.

As shown in FIG. 9, positive antenna feed terminal 96B is located adjacent to the right edge of patch 104B to ensure that patch 104B is impedance matched to transmission line 64B. Similarly, positive antenna feed terminal 96A is located adjacent to the left edge of patch 104A to ensures that patch 104A is impedance matched to transmission line 64A (e.g., positive antenna feed terminal 96B of FIG. 9 may be formed at the same location on patch 104B as shown in FIG. 7 and positive antenna feed terminal 96A of FIG. 9 may be formed at the same location on patch 104A as shown in FIG. 7). Positive antenna feed terminals 96A and 96B may cover the same polarization (e.g., positive antenna feed terminals 96A and 96B may form respective positive antenna feed terminals 96AV and 96BV or may form respective positive antenna feed terminals 96AH and 96BH of FIG. 8).

A hole such as hole 156 may be formed in patch 104A in alignment with positive antenna feed terminal 96B on patch 104B (e.g., outside of the central region of patch 104A). Ground plane 92 may include an additional hole 158B aligned with hole 156 and positive antenna feed terminal 96B. Conductive trace 126A in transmission line 64A may be coupled to positive antenna feed terminal 96A over a corresponding conductive via 154A extending through hole 158A in ground plane 92. Conductive trace 126B in transmission line 64B may be coupled to positive antenna feed terminal 96B over a single corresponding conductive via 154B (e.g., without horizontal trace 134 or additional conductive vias such as conductive via 138 of FIG. 7). Conductive via 154B may extend through hole 158B in ground plane 92 and hole 156 in patch 104A to positive antenna feed terminal 96B.

As shown in FIG. 9, patch 104B is interposed between patch 104A and first surface 164 of substrate 120. Patch 104A is interposed between ground plane 92 and patch 104B. Antenna ground 92 is interposed between patch 104A and second surface 166 of substrate 120. An integrated circuit or chip such as integrated circuit 140 may be mounted to surface 166 of substrate 120. Integrated circuit 140 may include radio-frequency transceiver circuitry (e.g., transceiver circuitry 28 of FIG. 2), some or all of control circuitry 14 (FIG. 2), or any other desired circuitry. The circuitry on integrated circuit 140 need not be formed on an integrated circuit and may be formed using other components that are mounted to substrate 120 if desired.

Integrated circuit 140 may include a number of ports 148 (e.g., radio-frequency input-output ports) coupled to antenna structures 70 over respective transmission lines 64. Integrated circuit 140 may, for example, include a corresponding port 148 for each positive antenna feed terminal on antenna structures 70. In the example of FIG. 9, integrated circuit 140 includes a first port 148A coupled to positive antenna feed terminal 96A over transmission line 64A and a second port 148B coupled to positive antenna feed terminal 96B over transmission line 64B. Integrated circuit 140 may include one or more ground ports coupled to ground plane 92. Port 148A may be coupled to conductive trace 126A over conductive via 150A. Port 148B may be coupled to conductive trace 126B over conductive via 150B.

If care is not taken, radio-frequency signals handled by antenna 40A may be electromagnetically coupled onto antenna 40B and/or radio-frequency signals handled by antenna 40B may be electromagnetically coupled onto antenna 40A (e.g., because conductive via 154B passes through patch 104A at a location for which antenna 40A exhibits a relatively high electric field magnitude). Antenna structures 70 may include impedance matching circuitry to ensure that antennas 40A and 40B are sufficiently isolated even though conductive via 154B does not pass through the center of patch 104A.

The impedance matching circuitry may include impedance matching circuits 162 external to integrated circuit 140 (e.g., a first impedance matching circuit 162A and a second impedance matching circuit 162B) and impedance matching circuits 146 within integrated circuit 140 (e.g., a third impedance matching circuit 146A and a fourth impedance matching circuit 146B). Impedance matching circuits 146 may be omitted if desired.

As shown in FIG. 9, impedance matching circuits 162A and 162B may be mounted to surface 166 of substrate 120. Impedance matching circuit 162A may be coupled to conductive via 154A and thus transmission line 64A over conductive matching via 160A. Impedance matching circuit 162B may be coupled to conductive via 154B and thus transmission line 64B over conductive matching via 160B. Conductive matching via 160A may be aligned with conductive via 154A and thus positive antenna feed terminal 96A. Conductive matching via 160B may be aligned with conductive via 154B and thus positive antenna feed terminal 96B. Impedance matching circuits 162A and 162B may each include terminals coupled to ground 142 (e.g., grounded structures held at the same potential as ground plane 92). Ground 142 may include ground traces on surface 166 of substrate 120.

Impedance matching circuit 146A may be coupled between path 144A and port 148A. Path 144A may be coupled to transceiver circuitry in integrated circuit 140 (e.g., transceiver circuitry 28 of FIG. 2). Impedance matching circuit 146B may be coupled to path 144B and port 148B. Path 144B may be coupled to transceiver circuitry in integrated circuit 140 (e.g., transceiver circuitry 28 of FIG. 2). Impedance matching circuits 146A and 146B may each include terminals coupled to ground 142 if desired.

Impedance matching circuits 162A, 162B, 144A, and/or 144B may be adjusted (e.g., by control circuitry 14 of FIG. 2) to couple a selected amount of impedance to positive antenna feed terminals 96A and 96B based on whether positive antenna feed terminals 96A and/or 96B are active. The selected amount of impedance and the predetermined impedance of conductive vias 154A, 154B, 160A, and 160B may configure antenna structures 70 to exhibit sufficient isolation between antennas 40A and 40B.

For example, impedance matching circuits 162A, 162B, 144A, and 144B may be controlled using first settings when positive antenna feed terminal 96B is active and positive antenna feed terminal 96A is inactive, may be controlled using second settings when positive antenna feed terminal 96B is inactive and positive antenna feed terminal 96A is active, and may be controlled using third settings when both positive antenna feed terminals 96A and 96B are active (e.g., such that the antenna feeds are sufficiently isolated regardless of which feeds are active at any given time).

In one suitable arrangement, impedance matching circuit 162A may be controlled to exhibit a selected impedance such that a short circuit impedance to ground 142 is coupled to positive antenna feed terminal 96A or such that an open circuit impedance is interposed between conductive via 154A and ground 142. Similarly, impedance matching circuit 162B may be controlled to exhibit a selected impedance such that a short circuit impedance to ground 142 is coupled to positive antenna feed terminal 96B or such that an open circuit impedance is interposed between conductive via 154B and ground 142. This is merely illustrative and, in general, any desired fixed or variable impedance may be coupled between positive antenna feed terminals 96A and 96B and ground 142 using circuits 162A and 162B.

If desired, impedance matching circuit 146A may be configured to couple any desired impedance or an adjustable impedance between port 148A and ground 142 (e.g., when positive antenna feed terminal 96A is inactive) or to short port 148A to path 144A (e.g., when positive antenna feed terminal 96A is active). Similarly, impedance matching circuit 146B may be configured to couple any desired impedance or an adjustable impedance between port 148B and ground 142 (e.g., when positive antenna feed terminal 96B is inactive) or to short port 148B to path 144B (e.g., when positive antenna feed terminal 96B is active). By dynamically adjusting impedance matching circuits 162A, 162B, 146A, and/or 146B, control circuitry 14 (FIG. 2) may ensure that a suitable impedance is coupled to positive antenna feed terminals 96A and 96B at any given time so that antenna structures 70 exhibit satisfactory isolation (e.g., regardless of which positive antenna feed terminals are active). Impedance matching circuits 162A, 162B, 146A, and 146B may sometimes be referred to herein as adjustable impedance matching circuits.

Figure 10:
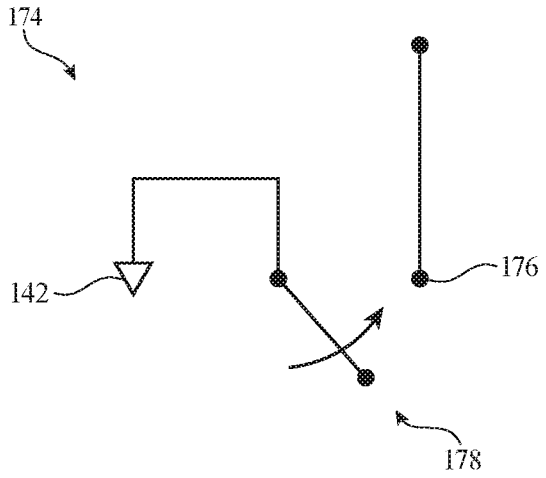
FIGS. 10-12 are circuit diagrams of illustrative components that may be used to form adjustable matching circuits of the type shown in FIG. 9 in accordance with an embodiment.
Figure 11:
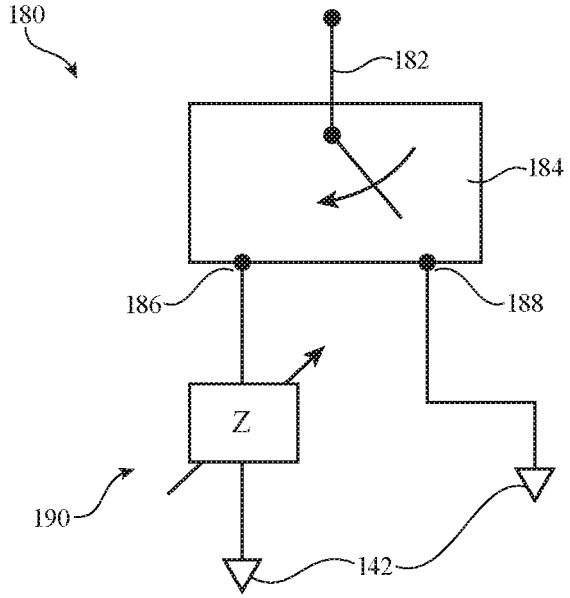
Figure 12:
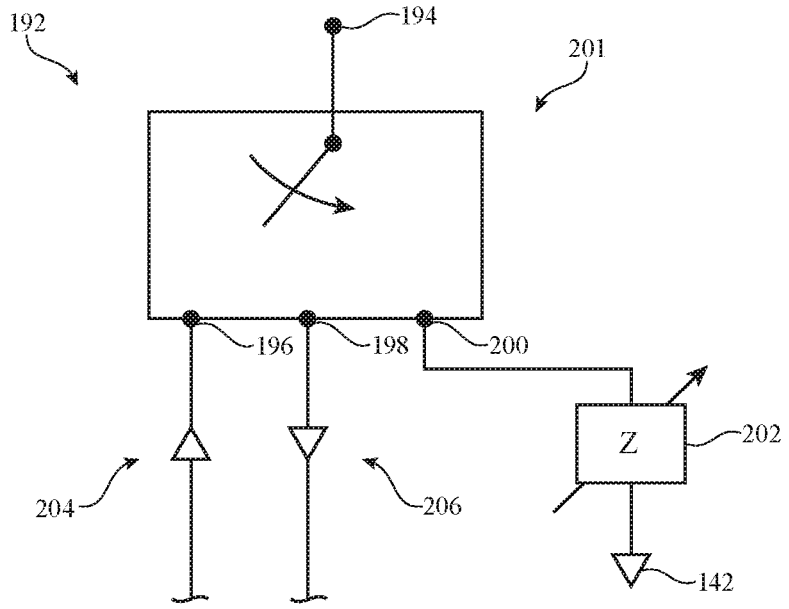

FIGS. 10-12 are circuit diagrams of circuitry that may be used to form impedance matching circuits 162A, 162B, 144A, and/or 144B of FIG. 9. As shown in FIG. 10, impedance matching circuit 174 may include a switch 178 coupled to ground 142. Switch 178 may, for example, be a single-pole single-throw (SPST) switch having a first state at which an open circuit is coupled between ground 142 and terminal 176 and having a second state at which a short circuit path is coupled between ground 142 and terminal 176. In this way, an open circuit or short circuit impedance to ground may be coupled to terminal 176.

Impedance matching circuit 174 of FIG. 10 may, for example, be used to form impedance matching circuits 162A and/or 162B of FIG. 9. Terminal 176 may be coupled to conductive matching vias 160A or 160B. Switch 178 may be implemented using discrete switching components that are mounted to surface 166 of substrate 120 (FIG. 9) using surface mount technology (SMT) (e.g., switch 178 may be an SMT component).

This example of FIG. 10 is merely illustrative and, if desired, additional components may be used so that any desired impedance is coupled between ground 142 and terminal 176 when switch 178 is open or closed. As shown in FIG. 11, impedance matching circuit 180 may include a switch 184 having a first switch terminal 182, a second switch terminal 186, and a third switch terminal 188. An adjustable or fixed impedance circuit 190 may be coupled between switch terminal 186 and ground 142. Impedance circuit 190 may include any desired resistive, inductive, capacitive, and/or switching components arranged in any desired manner. Control circuitry 14 (FIG. 2) may provide control signals to actively adjust the impedance of impedance circuit 190 if desired. Switch terminal 188 may be coupled to ground 142.

Switch 184 may have a first state in which switch terminal 182 is coupled to switch terminal 186 to couple a fixed or adjustable impedance between terminal 182 and ground 142. Switch 184 may have a second state in which switch terminal 182 is coupled to switch terminal 188 to form a short circuit path from terminal 182 to ground 142. Switch 184 may optionally have a third state in which an open circuit impedance is coupled to switch terminal 182.

Impedance matching circuit 180 of FIG. 11 may, for example, be used to form impedance matching circuits 162A and/or 162B of FIG. 9. In this way, control circuitry 14 (FIG. 2) may control impedance matching circuit 180 to couple any desired impedance to positive antenna feed terminals 96A and/or 96B (e.g., to ensure that antenna 40A is sufficiently isolated from antenna 40B). Terminal 182 may be coupled to conductive matching vias 160A or 160B. Switch 184 and impedance circuit 190 may include SMT components that are mounted to surface 166 of substrate 120 (FIG. 9) if desired.

As shown in FIG. 12, impedance matching circuit 192 may include a switch 201 having a first switch terminal 194, a second switch terminal 196, a third switch terminal 198, and a fourth switch terminal 200. An adjustable or fixed impedance circuit 202 may be coupled between switch terminal 200 and ground 142. Impedance circuit 202 may include any desired resistive, inductive, capacitive, and/or switching components arranged in any desired manner. Control circuitry 14 (FIG. 2) may provide control signals to actively adjust the impedance of impedance circuit 202 if desired. Switch terminal 196 may be coupled to transceiver circuitry (e.g., transceiver circuitry 28 of FIG. 2) via power amplifier 204. Switch terminal 198 may be coupled to the transceiver circuitry via low noise amplifier 206.

Impedance matching circuit 192 of FIG. 12 may, for example, be used to form impedance matching circuits 146A and/or 146B of FIG. 9 (e.g., switch terminals 196 and 198 may be coupled to a corresponding path 144 of FIG. 9). Control circuitry 14 (FIG. 2) may control impedance matching circuit 192 to couple any desired impedance to ports 148 of integrated circuit 140 (FIG. 9) or to couple ports 148 to transceiver circuitry when the corresponding positive antenna feed terminal is active. Switch 201 and impedance circuit 202 may include circuit components that are integrated within integrated circuit 140 of FIG. 9, for example.

Switch 201 may have a first state in which switch terminal 194 is coupled to switch terminal 200 to couple a fixed or adjustable impedance between switch terminal 194 and ground 142 (e.g., to the corresponding port 148 of integrated circuit 140 of FIG. 9). Switch 201 may have a second state in which switch terminal 194 is coupled to switch terminal 198 so that radio-frequency signals received by the corresponding positive antenna feed terminal are passed to the transceiver circuitry via low noise amplifier 206. Switch 201 may have a third state in which switch terminal 194 is coupled to switch terminal 196 so that radio-frequency signals transmitted by the transceiver circuitry are conveyed to the corresponding positive antenna feed terminal via power amplifier 204.

In one suitable arrangement, switch 201 may couple switch terminal 194 to switch terminal 200 when the positive antenna feed terminal coupled to switch terminal 194 is inactive. This may adjust the impedance of the port 148 coupled to switch terminal 194 to ensure that the antennas operate with satisfactory isolation and antenna efficiency. Switch 201 may couple switch terminal 194 to one of switch terminals 196 and 198 when the positive antenna feed terminal 96 coupled to switch terminal 194 is active.

Figure 13:
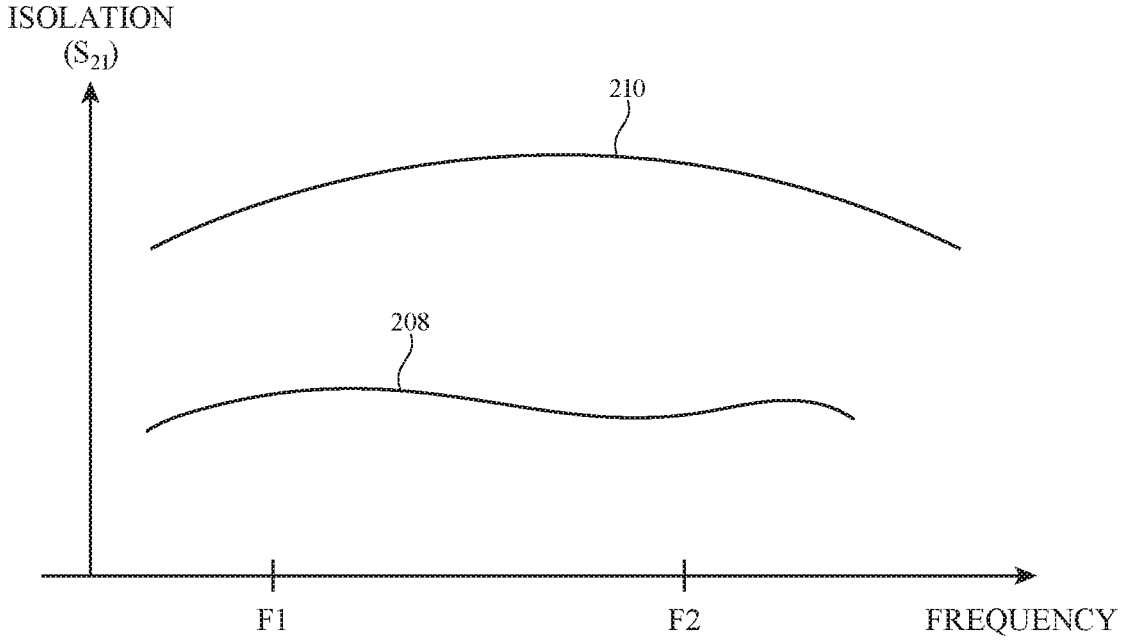
FIG. 13 is a graph of isolation between co-located patch antennas of the types shown in FIGS. 7-9 in accordance with an embodiment.

FIG. 13 is a graph of isolation ($S_{21}$) for antennas 40A and 40B. For example, curve 208 corresponds to scenarios where antenna 40B is coupled to transmission line 64B over a single conductive via without impedance matching circuits 162A, 162B, 146A, or 146B. In this scenario, the relatively high magnitude electric field near the edge of patch 104A may cross-couple with the conductive via as the conductive via passes through patch 104A, resulting in a relatively low isolation at desired frequencies (e.g., frequencies including a first frequency F1 in a first communications band such as a communications band from 27.5 GHz to 29.5 GHz and a second frequency F2 in a second communications band such as a communications band from 37 GHz to 41 GHz). Such low isolation may reduce the overall antenna efficiency for antenna structures 70 and generate errors in the conveyed wireless data.

Curve 210 corresponds to antenna structures 70 of the types shown in FIGS. 7-9. Forming impedance matching circuits 162A, 162B, 146A, and/or 146B of FIG. 9 may allow active adjustment of the feed impedance for antennas 40A and 40B to achieve a relatively high level of isolation. Similarly, passing conductive via 124B of FIG. 7 through the central region of patch 104A may minimize the amount of coupling between patch 104A and the feed path for antenna 40B, thereby allowing antennas 40A and 40B to achieve a relatively high level of isolation. In this way, antennas 40A and 40B may be co-located within device 10 (thereby minimizing space consumption) while also exhibiting satisfactory isolation and thus antenna performance within multiple communications bands above 10 GHz.

The foregoing is merely illustrative and various modifications can be made by those skilled in the art without departing from the scope and spirit of the described embodiments. The foregoing embodiments may be implemented individually or in any combination.

What is claimed is:

1. Antenna structures configured to radiate in first and second frequency bands higher than 10 GHz, comprising:

a stacked dielectric substrate having a first, second, third, and fourth layers, the second layer being interposed between the first and third layers, and the third layer being interposed between the second and fourth layers;

a ground plane on the first layer;

a first conductive patch on the second layer and comprising a first positive antenna feed terminal and an opening;

a second conductive patch on the fourth layer and comprising a second positive antenna feed terminal; and a transmission line comprising a first conductive via coupled to the second positive antenna feed terminal, a second conductive via extending through the opening, and a conductive trace on the third layer that couples the first conductive via to the second conductive via.

2. The antenna structures defined in claim 1, wherein the first conductive patch is configured to generate an electric field and the opening is aligned with a location on the first conductive patch at which the generated electric field exhibits a minimum magnitude.

3. The antenna structures defined in claim 2, wherein the first conductive patch has a length and the location on the first conductive patch is halfway across the length.

4. The antenna structures defined in claim 1, wherein the conductive trace has a length configured to match an impedance of the second conductive patch to an impedance of the transmission line.

5. The antenna structures defined in claim 1, wherein the first conductive patch comprises an additional opening and the second conductive patch comprises a third positive antenna feed terminal, the antenna structures further comprising:

an additional transmission line that includes a third conductive via coupled to the third positive antenna feed terminal, a fourth conductive via extending through the additional opening, and an additional conductive trace on the third layer that couples the third conductive via to the fourth conductive via.

6. The antenna structures defined in claim 5, wherein the first conductive patch comprises a fourth positive antenna feed terminal, the first and second positive antenna feed terminals are configured to convey radio-frequency signals with a first polarization, and the third and fourth positive antenna feed terminals are configured to convey radio-frequency signals with a second polarization orthogonal to the first polarization.

7. The antenna structures defined in claim 1, further comprising:

a hole in the ground plane that is aligned with the opening in the first conductive patch, wherein the second conductive via extends through the first layer, the hole, the second layer, and the third layer, and the first conductive via extends through the fourth layer.

8. The antenna structures defined in claim 1, wherein the dielectric substrate comprises a fifth layer, the first layer is interposed between the fifth and second layers, and the transmission line further comprises an additional conductive trace on the fifth layer that is coupled to the second conductive via.

9. The antenna structures defined in claim 1, further comprising:

an additional transmission line that includes a third conductive via coupled to the first positive antenna feed terminal.

10. The antenna structures defined in claim 1, wherein the first conductive patch is configured to radiate in the first frequency band, the second conductive patch is configured to radiate in the second frequency band, and the second frequency band is higher than the first frequency band.

11. The antenna structures defined in claim 10, wherein the first frequency band comprises a frequency band between 27.5 GHz and 29.5 GHz and the second frequency band comprises a frequency band between 37 GHz and 41 GHz.

12. An electronic device comprising:

radio-frequency transceiver circuitry configured to transmit radio-frequency signals at a frequency between 10 GHz and 300 GHz;

a first patch antenna resonating element having a central region with a hole;

a second patch antenna resonating element at least partially overlapping the first patch antenna resonating element and having a positive antenna feed terminal;

a first conductive via extending through the hole;

a second conductive via coupled to the positive antenna feed terminal and laterally offset with respect to the first conductive via; and a conductive path coupled between the first and second conductive vias, wherein the first conductive via, the conductive path, and the second conductive via are configured to convey the radio-frequency signals transmitted by the radio-frequency transceiver circuitry to the positive antenna feed terminal.

* * * * *